US005115720A

United States Patent [19]

Babson et al.

[11] Patent Number: 5,115,720

[45] Date of Patent: May 26, 1992

[54] HYDRAULIC VALVE BANK

[75] Inventors: Vincent L. Babson, Monks Corner; Lee A. Hagelbarger, Charleston, all of S.C.

[73] Assignee: Baker Material Handling Corporation, Summerville, S.C.

[21] Appl. No.: 503,279

[22] Filed: Apr. 2, 1990

[51] Int. Cl.[5] ..... F15B 11/00; F15B 13/00

[52] U.S. Cl. ..... 91/448; 91/454; 91/465; 91/519; 91/532

[58] Field of Search ..... 91/415, 417, 532, 519, 91/521, 525, 531, 508, 448, 465, 462, 463, 436, 454

[56] References Cited

U.S. PATENT DOCUMENTS

| | | | |
|---|---|---|---|
| 2,622,565 | 12/1952 | Venus | 91/417 R X |
| 3,033,170 | 5/1962 | Norton et al. | 91/417 R X |
| 3,313,316 | 4/1967 | Thomas | 91/521 |
| 3,874,407 | 4/1975 | Griswold | 91/417 R X |
| 4,102,132 | 7/1978 | Palmer | 91/530 |
| 4,136,519 | 1/1979 | Field et al. | 60/433 |
| 4,182,219 | 1/1980 | Baatrup | 91/415 X |
| 4,281,584 | 8/1981 | Onken et al. | 91/417 R X |
| 4,673,162 | 6/1987 | Lachmann | 91/417 R X |
| 4,745,844 | 5/1988 | Larsen | 91/530 |
| 4,917,001 | 4/1990 | Yoshikawa et al. | 91/448 |
| 4,958,495 | 9/1990 | Yamaguchi | 91/417 R X |
| 4,961,316 | 10/1990 | Corke et al. | 60/433 |

FOREIGN PATENT DOCUMENTS

| | | | |
|---|---|---|---|
| 969468 | 5/1958 | Fed. Rep. of Germany | 91/417 R |
| 2246809 | 3/1974 | Fed. Rep. of Germany | 91/417 R |
| 62701 | 4/1984 | Japan | 91/417 R |

*Primary Examiner*—Edward K. Look
*Assistant Examiner*—Hoang Nguyen
*Attorney, Agent, or Firm*—Tarolli, Sundheim & Covell

[57] ABSTRACT

An industrial truck has a hydraulic fluid supply and at least one double-acting hydraulic cylinder assembly for moving a movable element of the vehicle. The cylinder assembly includes a cylinder having a fluid chamber therein, and a piston movable axially in the cylinder. An actuator rod extends from the piston for connection to the movable element. The piston divides the fluid chamber into a rod end chamber and a piston end chamber each having hydraulic fluid therein. A pair of two-way two-position poppet valves are selectively actuatable between a first joint state in which both of the valves are in a normally closed position in which the piston does not move; a second joint state in which a first one of the valves is closed and a second one of the valves is open to move the piston in a first direction; and a third joint state in which the first one of the valves is open and the second one of the valves is closed to move the piston in a second direction opposite to the first direction.

4 Claims, 4 Drawing Sheets

HYDRAULIC VALVE BANK

BACKGROUND OF THE INVENTION

1. Technical Field

The present invention relates to industrial trucks, and particularly to fork lift trucks which use hydraulically operated linear actuators to control movement of the forks of the truck.

2. Description of the Prior Art

A typical prior art fork lift truck has load forks mounted on a carriage. The carriage is movable vertically on a mast assembly to raise and lower the forks. The mast assembly including the carriage can be tilted forward and back about a transversely extending tilt axis. In some fork lift trucks, the carriage with the forks can also be extended and retracted, and shifted from side to side. Each of these functions is controlled by a separate hydraulic cylinder assembly.

The flow of fluid into and out of the hydraulic cylinder assembly is controlled one or more of valves located in line between a pump and a tank or return. Double-acting hydraulic cylinder assemblies are most often used. Each double-acting hydraulic cylinder assembly has a piston slidably disposed in a cylinder. An actuator rod extends axially from the piston through one end of the cylinder and is connected to the portion of the carriage or mast to be moved. The piston divides the cylinder into a rod end chamber and a piston end chamber.

A four-way three-position directional control valve is normally used to control the operation of the double-acting hydraulic cylinder assembly. In a first position, the valve directs fluid under pressure to the rod end of the cylinder and allows displaced fluid to flow from the piston end of the cylinder through the valve to return. The actuator rod moves toward the piston end of the cylinder. In a second position, the valve directs fluid under pressure to the piston end of the cylinder and allows displaced fluid to flow from the rod end of the cylinder through the valve to return. The actuator rod moves toward the rod end of the cylinder. In a third position, no fluid can flow through the valve, and the hydraulic cylinder assembly is not actuated to move in either direction.

Although it works adequately to control the hydraulic cylinder assembly, a four-way three-position directional control valve is relatively large and expensive. Using a separate four-way three-position valve to control each of the four above-mentioned functions in a lift truck entails a substantial expense and uses a substantial amount of space. It would be desirable to provide a different manner of controlling the actuation of the hydraulic cylinder assemblies in a fork lift truck which would require less space and would also cost less.

SUMMARY OF THE INVENTION

The present invention is for use in a vehicle having a hydraulic fluid supply, a fluid return, and at least one double-acting hydraulic cylinder assembly for moving a movable element of the vehicle. The cylinder assembly includes a cylinder having a fluid chamber therein and a piston axially movable in the cylinder. A rod extends axially from the piston. The piston divides the fluid chamber into a rod end chamber and a piston end chamber each having hydraulic fluid therein. The hydraulic fluid in the rod end chamber and the hydraulic fluid in the piston end chamber exert opposing axially directed forces on the piston.

In accordance with the present invention, a pair of two-way two-position poppet valves are selectively actuatable to direct fluid under pressure into one of the rod end chamber and the piston end chamber while directing fluid out of the other one of the rod end chamber and the piston end chamber. The valves are selectively actuatable between a first joint state in which both of the valves are normally in a closed position so that the opposing forces exerted by the hydraulic fluid in the rod end chamber and the piston end chamber do not move the piston, a second joint state in which a first one of the valves is closed and a second one of the valves is open to move the piston in a first direction, and a third joint state in which the first valve is open and the second valve is closed to move the piston in a second direction opposite to the first direction.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
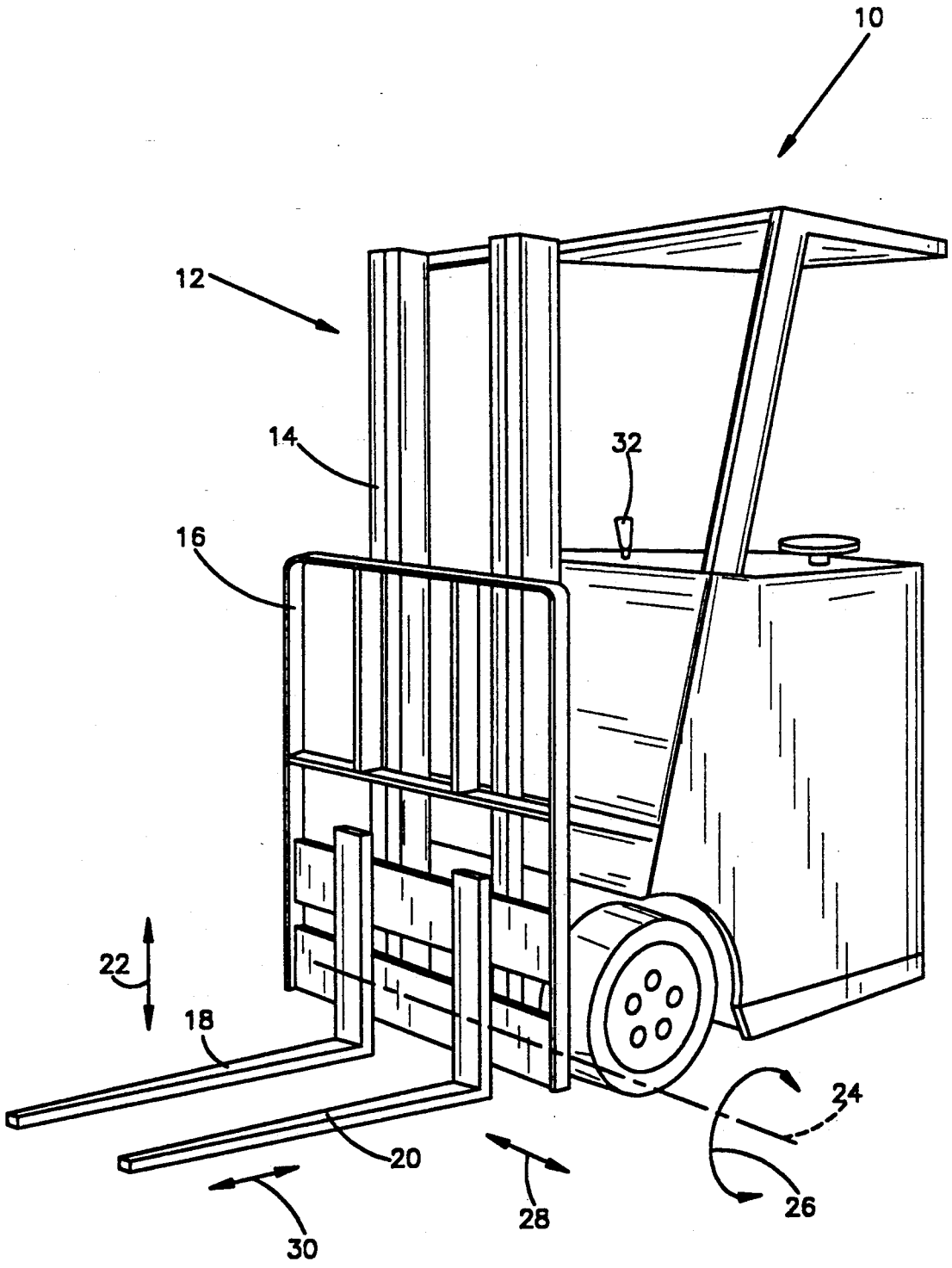
FIG. 1 is a view of a fork lift truck embodying the present invention.

FIG. 1 illustrates the invention as embodied in a fork lift truck 10, although it should be understood that the invention may be embodied in other types of vehicles requiring the control of hydraulic cylinder assemblies. The truck 10 has a mast assembly 12 which includes a base portion 14 and a carriage 16. The carriage 16 includes a pair of forks 18 and 20 for placement under a load to be moved.

The carriage 16 can be raised and lowered along the mast base portion 14, in the vertical direction indicated by the arrows 22. This function is called the "hoist" function and is controllable by the operator of the truck 10.

The mast assembly 12, including the carriage 16 and the forks 18 and 20, can be tilted relative to the rest of the truck 10, about an imaginary tilt axis 24, in the directions indicated by the arrows 26. This function is called the "tilt" function and is also controllable by the operator of the truck 10.

The carriage 16, with the forks 18 and 20, can be shifted left and right relative to the base portion 14 of the mast assembly 12, in the directions indicated by the arrows 28. This function is called the "side shift" function and is also controllable by the operator of the truck 10.

The carriage 16, with the forks 18 and 20, can be moved forward and back, relative to the base portion 14 of the mast assembly 12 in the directions indicated by the arrows 30. This function is called the "extend and retract" function and is also controllable by the operator of the truck 10.

These four functions, that is, hoist, tilt, side shift, and extend and retract, are all controlled by a pressurized hydraulic system (not shown in FIG. 1) in the truck 10 which includes hydraulic circuitry and actuators for controlling these functions. The system is energized by an operator through a pistol-grip control 32. Each function is actuated by at least one hydraulic piston-cylinder assembly. The introduction of hydraulic fluid under pressure into a cylinder causes its associated piston to move relative to the cylinder generating a motive force sufficient to move the mast assembly 12 or the carriage 16 as desired.

Figure 2:
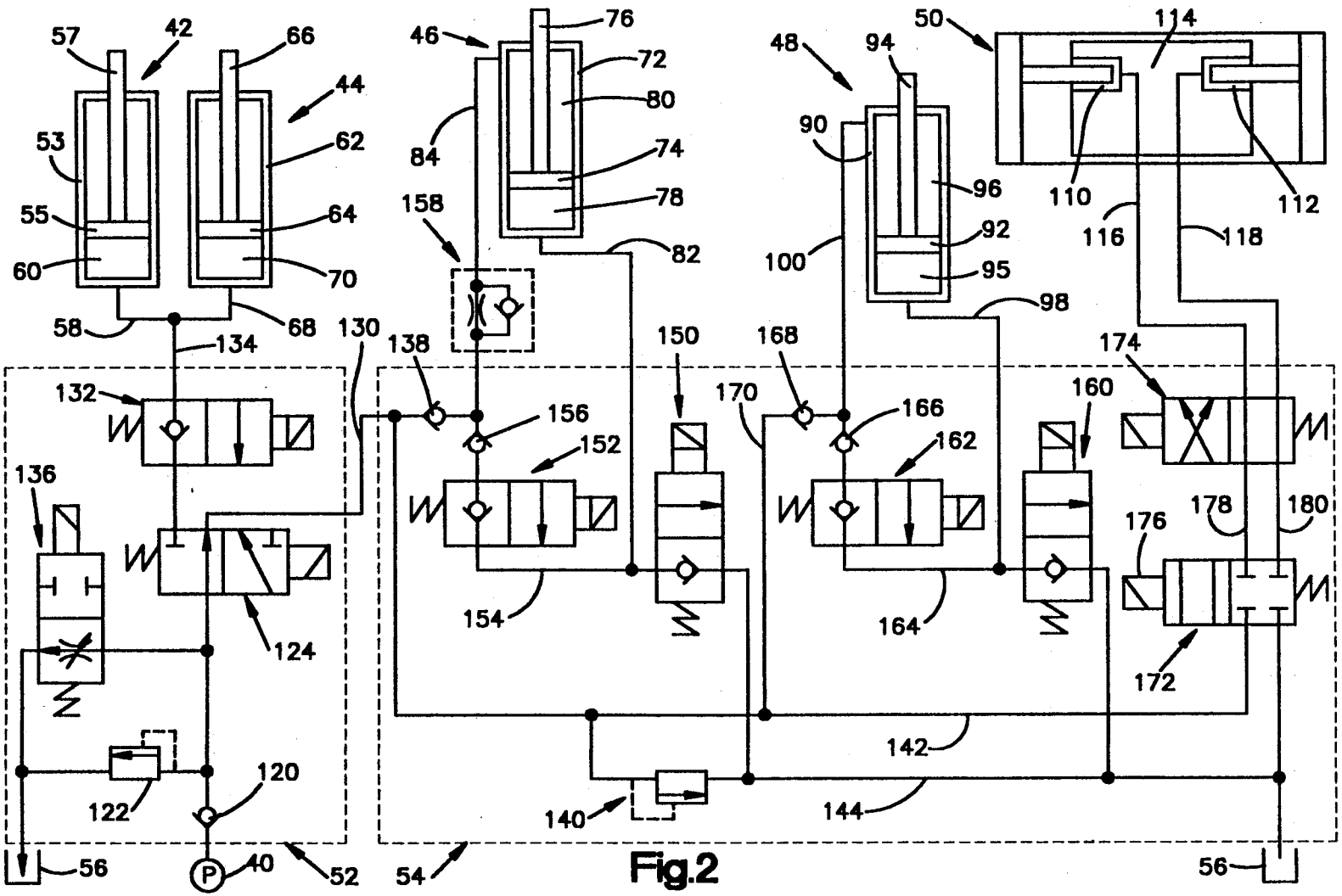
FIG. 2 is a schematic view of hydraulic circuitry of the fork lift truck of FIG. 1 including a tilt cylinder.

FIG. 2 illustrates schematically portions of the hydraulic system of the truck 10 which are pertinent to the control of the four functions. The system includes a fluid pressure supply source or pump 40. A pair of hydraulic cylinder assemblies 42 and 44 are simultaneously operable to raise and lower (hoist) the carriage 16 along the base portion 14 of the mast assembly 12. A hydraulic cylinder assembly 46 is operable to tilt the mast assembly 12 relative to the rest of the truck 10. A hydraulic cylinder assembly 48 is operable to extend and retract the carriage 16 relative to the base portion 14 of the mast assembly 12. An integral side shifter 50 is operable to shift the carriage assembly 16 sideways relative to the base portion 14 of the mast assembly 12. Valve blocks 52 and 54 contain valves and other circuitry for controlling the actuation of the various hydraulic cylinder assemblies. A hydraulic fluid tank or return 56 receives fluid exhausted for return to the pump 40.

The hydraulic cylinder assembly 42 is a single acting linear actuator and includes a cylinder 53 having a piston 55 therein. An actuator rod 57 extends axially from the piston 55 through one end of the cylinder 53. The cylinder assembly 42 is actuatable upon the introduction of hydraulic fluid under pressure through a supply line 58 into a piston end chamber 60. Similarly, the hydraulic cylinder assembly 44 is a single acting linear actuator and includes a cylinder 62 having a piston 64 therein. An actuator rod 66 extends axially from the piston 64 through one end of the cylinder 62. The hydraulic cylinder assembly 44 is actuatable upon the introduction of hydraulic fluid under pressure through a supply line 68 into a piston end chamber 70.

The hydraulic cylinder assembly 46, the tilt cylinder, is a double acting unbalanced linear actuator and includes a cylinder 72 having a piston 74 disposed therein. An actuator rod 76 extends axially from the piston 74 through one end of the cylinder 72. The piston 74 divides the cylinder 72 into a piston end chamber 78 and a rod end chamber 80. Hydraulic fluid is supplied to and exhausted from the piston end chamber 78 by a line 82. Hydraulic fluid flows into and out of the rod end chamber 80 through a line 84.

The hydraulic cylinder 48, which controls the extend and retract function, is a double acting unbalanced linear actuator and includes a cylinder 90 having a piston 92 therein. An actuator rod 94 extends axially from the piston 92 through one end of the cylinder 90. The piston 92 divides the cylinder 90 into a piston end chamber 95 and a rod end chamber 96. Hydraulic fluid is supplied to and exhausted from the piston end chamber 94 by a line 98. Hydraulic fluid flows into and out of the rod end chamber 96 through a line 100.

The integral side shifter 50, which controls the side shift function, is a double-acting balanced linear actuator having a pair of chambers 110 and 112 and a movable actuator 114. Hydraulic fluid under pressure is supplied to and exhausted from the cylinder 110 by a line 116. Hydraulic fluid under pressure is supplied to and exhausted from the cylinder 112 by a line 118.

The valve block 52 includes circuitry for controlling operation of the hoist cylinders 42 and 44. A check valve 120 prevents back flow of hydraulic fluid into the pump 40. A relief valve 122 limits excess fluid pressure A valve 124 is operable between a first position, as shown in FIG. 2, in which fluid under pressure is directed externally of the valve block 52 through a line 130, and a second position in which the line 130 is blocked and fluid under pressure is directed through a valve 132 and a line 134 to the supply lines 58 and 68 for the hoist cylinders 42 and 44. A valve 136 is operable in conjunction with the valve 132 to drain fluid from the hoist cylinders 42 and 44.

The valve block 54 includes circuitry for controlling the operation of the tilt cylinder 46, the extend and retract cylinder 48, and the integral side shifter 50. A check valve 138 prevents back flow of fluid from the valve block 54 through the line 130. A relief valve 140 relieves excess pressure in a supply line 142, directing fluid into a return line 144.

A pair of valves 150 and 152 control the operation of the tilt cylinder 46. The valve 150 is located in line 82 extending between the piston end chamber 78 and the return 144. The valve 150 is a solenoid actuated, normally closed, two-way, two-position poppet valve. One type of valve which is suitable is a solenoid cartridge valve available from Waterman Hydraulics of Chicago, Illinois, Model No. 14C2S. This valve is a normally closed, two-way, two-position poppet valve with free reverse flow when the solenoid is either energized or de-energized. The valve 152 is located in a conduit 154 extending between the tilt cylinder fluid supply line 84 and the valve 150. The valve 152 is identical to the valve 150. A check valve 156 is located between the conduit 84 and the valve 152. A flow restrictor 158 is located in the line 84.

Similarly, a pair of valves 160 and 162 are operable to control the actuation of the cylinder 48. The valve 160 is located in the line 98 extending between the piston end chamber 95 and the fluid return 144. The valve 162 is located in a conduit 164 between the fluid supply line 100 and the valve 160. The valves 160 and 162 are identical to the valves 150 and 152, being solenoid actuated, normally closed two-way, two-position poppet valves. A check valve 166 is in line between the fluid supply 100 and the valve 162. A second check valve 168 is in the supply line 170 branching off from the main fluid supply 142.

A pair of valves 172 and 174 are operable to control the integral side shifter 50. The valve 172 is a two-position, four-way valve which is normally closed to block fluid flow into and out of the integral side shifter 50. To operate the integral side shifter 50, the valve 172 may be actuated by a solenoid 176 into a second position in which fluid is free to flow through lines 178 and 180 to the valve 174. When the valve 174 is in the position as shown in FIG. 2, fluid under pressure is directed through line 116 into cylinder 110 and fluid is exhausted from cylinder 112 through line 118. When the valve 174 is actuated to a second position, fluid under pressure is directed through line 118 into cylinder 112 and fluid is exhausted from the cylinder 110 through the line 116.

Figure 3:
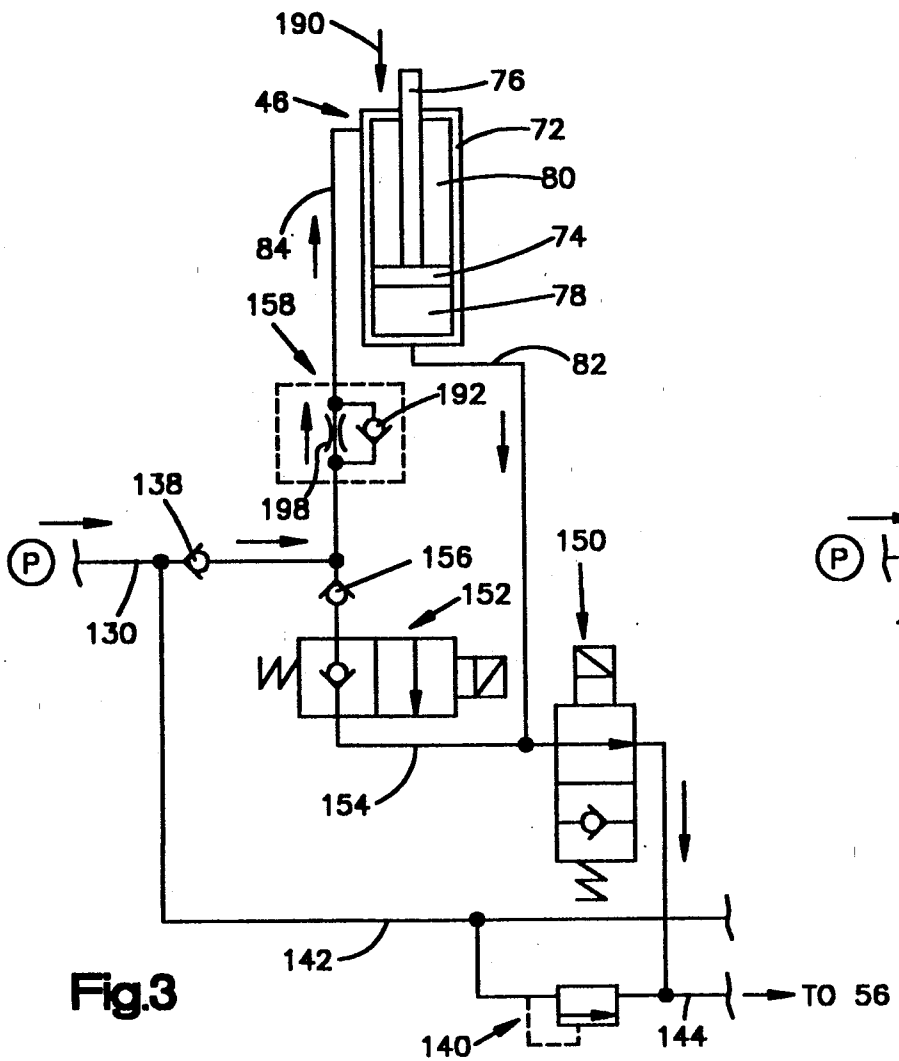
FIG. 3 is a schematic illustration showing actuation of the tilt cylinder in one direction.

FIG. 3 illustrates the actuation of the hydraulic circuitry for controlling the tilt cylinder 46, to move the actuator rod 76 in the direction indicated by the arrow 190 to tilt back the mast assembly 12. The valve 152 is maintained in its normally closed position. The valve 150 is energized, allowing fluid to flow out of the piston end chamber 78, through the line 82, to the return 56 via return line 144. Simultaneously, fluid under pressure from the pump 40 flows through the line 130, the check valve 138, the check valve 192, which is part of the flow restrictor 158, and through the supply line 84 into the rod end chamber 80. The piston 74 is moved in the direction indicated by the arrow 190, thus tilting back the mast assembly 12. Valve 150 is de-energized to stop the tilting back function. This closes the circuitry and maintains the tilt cylinder assembly 46 in a steady-state condition, in which the forces of the fluids acting on opposite sides of the piston 74 do not act to move the piston 74 relative to the cylinder 72.

Figure 4:
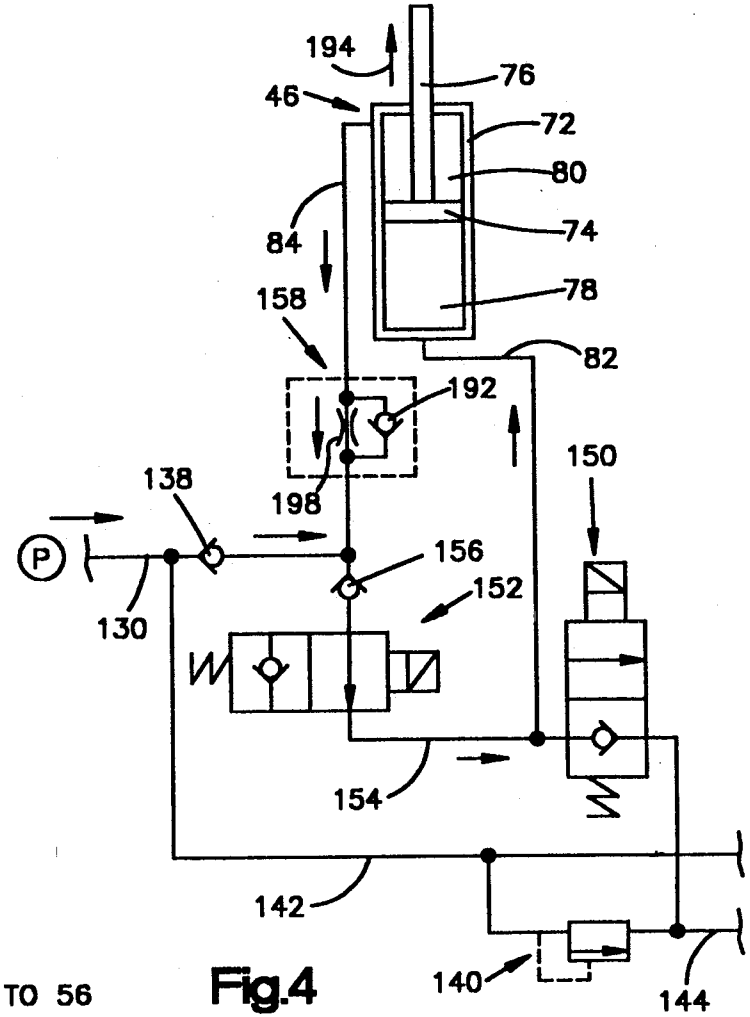
FIG. 4 is a schematic illustration showing actuation of the tilt cylinder in the opposite direction from FIG. 3.

FIG. 4 illustrates actuation of the tilt cylinder assembly 46 to move the piston 74 and the actuator rod 76 in the direction indicated by the arrow 194, to tilt the mast assembly 12 forward. The valve 152 is energized, while the valve 150 is maintained in its normally closed position. Fluid flows out of the rod end chamber 80, through the valve 152, into the piston end chamber 78. The piston 74 moves in the direction indicated by the arrow 194, and tilts the mast assembly 12 forward. Because the actuator rod 76 takes up volume in the rod end chamber 80, more fluid is needed to fill the piston end chamber 78 than is forced out of the rod end chamber 80. This fluid is made up from the system supply, coming from the pump 40 through the conduit 130 and the check valve 138. Thus, energizing the valve 152 allows fluid under pressure from the pump 40 to flow into the piston end chamber 78, in addition to allowing fluid flowing out of the rod end chamber 80 to be recirculated into the piston end chamber 78. To stop the tilting forward function, the valve 152 is de-energized and the system returns to its steady state condition in which the fluid forces acting on opposite sides of the piston 74 do not act to move the piston 74 relative to the cylinder 72.

When the mast assembly 12 is being tilted forward, the force of gravity acting on a load on the forks 18 and 20 may tend to pull the actuator rod 76 out of the cylinder 72 too fast. Therefore, it is desirable to be able to carefully control the rate of fluid flow in the system out of the rod end chamber 80. For this purpose, the fluid which flows out of the rod end chamber 80 must flow through a flow limiting orifice 198 rather than freely through the check valve 192.

The extend and retract hydraulic cylinder assembly 48 (FIG. 2), like the tilt cylinder assembly 46, is controllable by a pair of two-way, two-position valves. To move the actuator rod 94 in the direction into the cylinder 90, the valve 160 is actuated, and the valve 162 is maintained in its normally closed condition. Fluid exhausts from the piston end chamber 95 to return, and fluid under pressure from the supply line 170 flows through the line 100 into the rod end chamber 96. To move the actuator rod 94 in the opposite direction, that is, out of the cylinder 90, the valve 162 is actuated, and the valve 160 is maintained in its normally closed condition. Fluid under pressure flows through the lines 164 and 98 into the piston end chamber 95, and fluid flows out of the rod end chamber 96 through the valve 162 and is recirculated into the piston end chamber 95. Makeup fluid is supplied to the piston end chamber 95 from the supply 170 passing through the valve 162.

The valves 172 and 174 may be used to control a different actuator 210 for the side shifting function. In the system shown in FIG. 5, the actuator 210 is a double-acting unbalanced hydraulic cylinder assembly similar to the tilt cylinder assembly 46 and the extend and retractor cylinder assembly 48. The actuator 210 includes a cylinder 212 having a piston 214 therein. An actuator rod 216 extends axially from the piston 214 through one end of the cylinder 212. The piston 214 divides the cylinder 212 into a piston end chamber 218 and a rod end chamber 220. Hydraulic fluid is supplied to and exhausted from the piston end chamber 218 by the line 118. Hydraulic fluid flows into and out of the rod end chamber 220 by the line 116.

Figure 5:
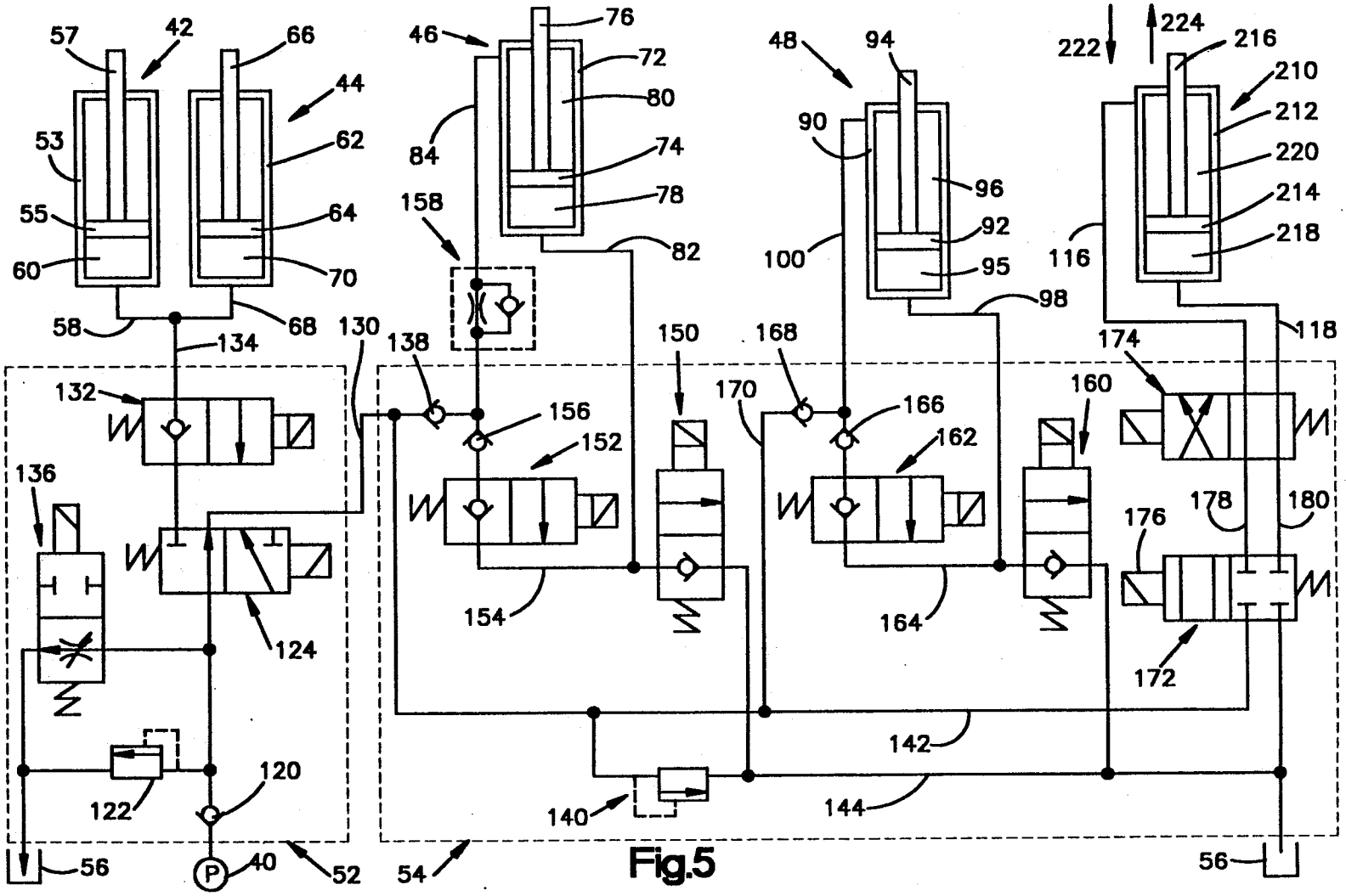
FIG. 5 is a schematic illustration similar to FIG. 2 but incorporating a different side shift actuator.

To actuate the side shift cylinder 210 in the other direction, the valve 172 is operated from its de-energized position shown in FIG. 5 to its energized position in which fluid is ported to the lines 178 and 180. To move the actuator rod 216 in the direction shown by the arrow 222, the valve 174 is maintained in its position shown in FIG. 5 so that fluid under pressure is directed into the rod end chamber 220 through the line 116. Simultaneously, fluid is exhausted from the piston end chamber 218 through the line 118 to return. To move the actuator rod 216 in the opposite direction 224, both the valve 172 and the valve 174 are energized so that fluid under pressure is directed through the line 118 into the piston end chamber 218. Simultaneously, fluid flows out of the rod end chamber 220 through the line 116 to return.

In summary, it can be seen that the present invention provides a compact, simple, and relatively inexpensive valve bank or valve arrangement for actuating any or all of the tilt function, extend and retract function, and side shift functions in a fork lift truck. Complicated, large and expensive four-way, three-position valves are not needed. Rather, simple, small and inexpensive two-way, two-position poppet valves are used.

From the above description of a preferred embodiment of the invention, those skilled in the art will perceive improvements, changes and modifications in the invention. Such improvements, changes and modifications within the skill of the art are intended to be covered by the appended claims.

We claim:

1. In a vehicle comprising:

an upright and tiltable mast assembly;

a carriage movable up and down said mast assembly;

fork means connected with said carriage for engaging a load;

hoist motor means connected with said carriage for moving said carriage along said mast assembly; said hoist motor means being operable between a retracted condition and an extended condition to move said carriage along said mast assembly;

tilt motor means connected with said mast for tilting said mast forwardly and rearwardly, said tilt motor means being operable between a retracted condition and an extended condition to tilt said mast;

hoist motor control valve means connected in fluid communication with said hoist motor means and a source of fluid pressure for controlling operation of said hoist motor means between the retracted and extended conditions; and tilt motor control valve means connected in fluid communication with said tilt motor means and a source of fluid pressure for controlling operation of said tilt motor means between the retracted and extended conditions;

the improvement wherein:

said hoist motor control valve means includes a first two-way valve operable between a first condition directing fluid from a source of fluid under pressure to said tilt motor control valve means and a second condition blocking fluid flow to said tilt motor control valve means, and a second two-way valve connected in fluid communication with said hoist motor means and said first two-way valve and operable between a first condition blocking fluid flow from said first two-way valve to said hoist motor means and a second condition enabling fluid to flow from said first two-way valve to said hoist motor means;

said tilt motor control valve means including a third two-way valve connected in fluid communication with said first two-way valve and with said tilt motor means, said third two-way valve being operable between a first condition blocking fluid flow through said third two-way valve to said tilt motor means and a second condition enabling fluid to flow from said first two-way valve through said third two-way valve to said tilt motor means; and said tilt motor control valve means including a fourth two-way valve connected in fluid communication with said tilt motor means and a reservoir for receiving fluid, said fourth two-way valve being operable between a first condition blocking fluid flow from said tilt motor means to the reservoir and a second condition enabling fluid to flow from said tilt motor means through said fourth two-way valve to the reservoir.

2. The improvement as set forth in claim 1 further including fork motor means connected with said fork means for extending and retracting said fork means, said fork motor means being operable between a retracted condition and an extended condition to extend and retract said forks;

fork motor control valve means connected in fluid communication with said fork motor means and a source of fluid pressure for controlling operation of said fork motor means between the retracted and extended conditions; and said fork motor control vale means including a fifth two-way valve connected in fluid communication with said first two-way valve and with said fork motor means, said fifth two-way valve being operable between a first condition blocking fluid flow through said fifth two-way valve to said fork motor means and a second condition enabling fluid to flow from said first two-way valve through said fifth two-way valve to said tilt motor means; and a sixth two-way valve connected in fluid communication with said fork motor means and the reservoir, said sixth two-way valve being operable between a first condition blocking fluid flow from said fork motor means to the reservoir and a second condition enabling fluid to flow from said fork motor means through said sixth two-way valve to the reservoir.

3. The improvement as set forth in claim 1 further including fork side shift motor means connected with said fork means for side shifting said fork means, and fork side shift motor control valve means comprising seventh and eighth valves connected in fluid communication with said fork side shift motor means and a source of fluid pressure for controlling operation of said fork side shift motor means.

4. The improvement as set forth in claim 3 further including fork motor means connected with said fork means for extending and retracting said fork means, said fork motor means being operable between a retracted condition and an extended condition to extend and retract said forks;

fork motor control valve means connected in fluid communication with said fork motor means and a source of fluid pressure for controlling operation of said fork motor means between the retracted and extended conditions; and said fork motor control valve means including a fifth two-way valve connected in fluid communication with said first two-way valve and with said fork motor means, said fifth two-way valve being operable between a first condition blocking fluid flow through said fifth two-way valve to said fork motor means and a second condition enabling fluid to flow from said first two-way valve through said fifth two-way valve to said tilt motor means; and a sixth two-way valve connected in fluid communication with said fork motor means and the reservoir, said sixth two-way valve being operable between a first condition blocking fluid flow from said fork motor means to the reservoir and a second condition enabling fluid to flow from said fork motor means through said sixth two-way valve to the reservoir.

* * * * *